US005778898A

United States Patent [19]

Bae et al.

[11] Patent Number: 5,778,898

[45] Date of Patent: Jul. 14, 1998

[54] SELF-EXTINGUISHING CIGARETTE, CIGAR, AND THE LIKE

[76] Inventors: Tae Hong Bae; Sang Yun Bae; Sang Il Bae, all of 6898 Old Annapolis Rd., Linthicum, Md. 21090

[21] Appl. No.: 325,157

[22] Filed: Oct. 20, 1994

[51] Int. Cl.[6] ..... A24D 1/02

[52] U.S. Cl. ..... 131/349

[58] Field of Search ..... 131/365, 349

[56] References Cited

U.S. PATENT DOCUMENTS 2,965,107 3/1960 Lehv .
2,979,410 4/1961 Parlour .
3,017,302 1/1962 Hultkrans .
3,091,243 5/1963 Guida .
5,002,073 3/1991 Chiang .
5,345,953 9/1994 Taylor .

*Primary Examiner*—V. Millin
*Assistant Examiner*—W. Deane
*Attorney, Agent, or Firm*—Birch,Stewart, Kolasch & Birch, LLP

[57] ABSTRACT

A self-extinguishing cigarette includes a cigarette body, a deformed sleeve made of vinyl plastics for slidably moving around the cigarette body, and an annular stopper attached on one end of a cigarette filter, whereby, upon moving the sleeve to a flame position of a lit end of the cigarette body, the lit cigarette is immediately extinguished by being squeezed and wrinkled by the sleeve.

6 Claims, 1 Drawing Sheet

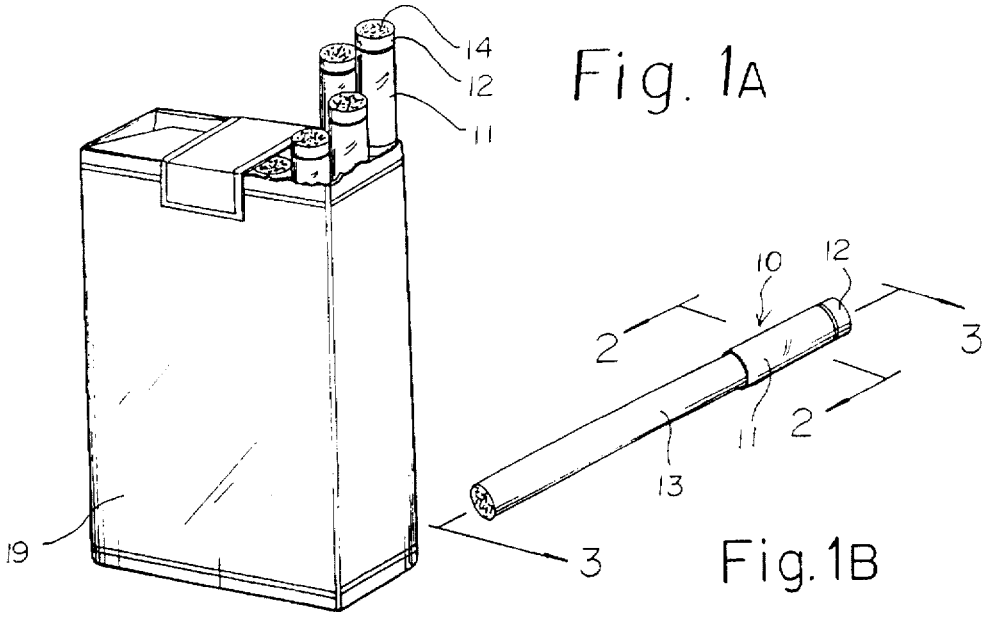
Fig. 1A
Fig. 1B
Fig. 2
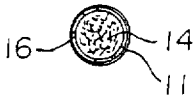
Fig. 3A
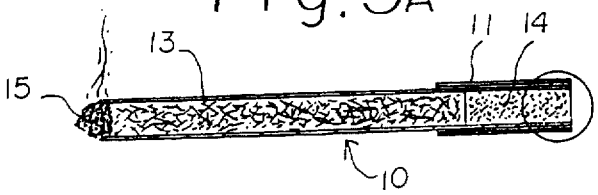
Fig. 3B
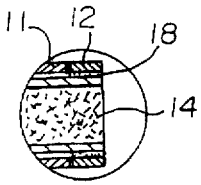
Fig. 4
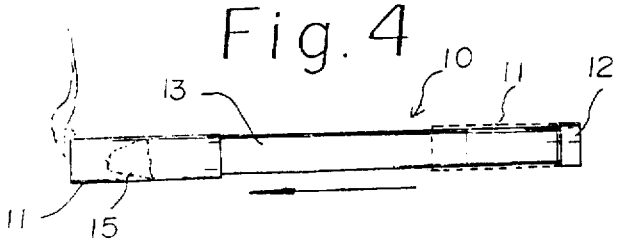
Fig. 5
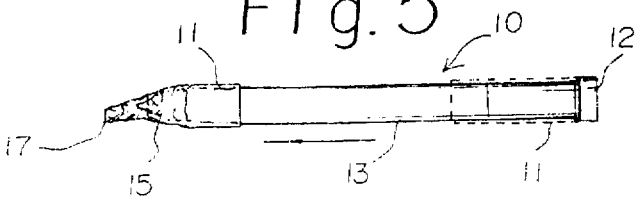

SELF-EXTINGUISHING CIGARETTE, CIGAR, AND THE LIKE

BACKGROUND OF THE INVENTION

1. Field of the Invention

The present invention relates to a self-extinguishing cigarette and more particularly, to a self-extinguishing mechanism for extinguishing the flame at any point on the body of the cigarettes, cigars, rolled tobacco products, and the like.

2. Description of Related Art

Generally, it has been known that lit cigarettes, or cigars, carelessly discarded or left in an ashtray are one of the major reasons for accidental fires in the home and other areas, causing tragedies that could be avoided. An additional problem concerned with cigarettes, cigars, and the like is the disposing of the same after they are finished or the preservation of unfinished cigarettes, cigars, and the like. Various types of snuffing devices for extinguishing ignited cigarettes, cigars, and the like have been known for a long time. Such typical examples are seen in U.S. Pat. Nos. 2,965,107, 2,970,410, 3,017,302, 5,002,073, and 5,345,953. However, by using such conventional cigarette extinguishing devices, the ignited end of the cigarettes or cigars will be extinguished in approximately eight seconds, in the complete absence of any unpleasant odors, sparks, or ashes. Because such conventional cigarette extinguishing devices are a kind of a rigid sleeve, which does not melt and maintains form stability when exposed to the heat of a cigarette, these devices are slow in extinguishing the cigarette. Therefore, since it takes for a long time to extinguish the lit cigarette, it is possible to spark, so that it is dangerous. In addition, the rigid sleeves are made from expensive heat resistant material such as precious or semi-precious metals.

Another disadvantage of such conventional cigarette extinguishing mechanisms is that they require a separate device such as a cigarette snuffer, so that it is not convenient because a separate device must be carried.

Still another disadvantage of such conventional cigarette extinguishing devices is that they cannot be used with the conventional cigarette packages, so that it is uneconomical.

SUMMARY OF THE INVENTION

Accordingly, it is an object of the present invention to provide an improved self-extinguishing cigarette, cigar, and the like, which eliminates the above problems encountered with conventional cigarette extinguishing devices.

Another object of the present invention is to provide a self-extinguishing cigarette including a cigarette body, a deformable sleeve made of vinyl plastics for slidably moving around the cigarette body so as to extinguish the lit cigarette in one or two seconds by squeezing and wrinkling the sleeve at a hot temperature very quickly.

A further object of the present invention is to provide a self-extinguishing cigarette further including an annular stopper attached on end portion of the cigarette filter for preventing the sleeve from sliding off of the cigarette body.

Still another object of the present invention is to provide a self-extinguishing cigarette, cigar, or the like, which is simple in structure, compact for portability, inexpensive to manufacture, durable in use, and refined in appearance.

Other objects and further scope of applicability of the present invention will become apparent from the detailed description given hereinafter. It should be understood, however, that the detailed description and specific examples, while indicating preferred embodiments of the invention, are given by way of illustration only, since various changes and modifications within the spirit and scope of the invention will become apparent to those skilled in the art from this detailed description.

Briefly described, the present invention is directed to a self-extinguishing cigarette including a cigarette body, a deformed sleeve made of vinyl plastics for slidably moving around the cigarette body, and an annular stopper attached on at least one end of a cigarette filter, whereby, upon moving the sleeve to a flame position of the lit end of the cigarette body, the lit cigarette is immediately extinguished by the sleeve which is squeezed and wrinkled by the exposure to the heat of the cigarette.

BRIEF DESCRIPTION OF THE DRAWINGS

The present invention will become more fully understood from the detailed description given hereinbelow and the accompanying drawings which are given by way of illustration only, and thus, are not limitative of the present invention, and wherein:

FIG. 1A is a perspective view of a package of the self-extinguishing cigarettes according to the present invention;

FIG. 1B shows a separate self-extinguishing cigarette of the present invention;

FIG. 2 is a cross-sectional view of the separate self-extinguishing cigarette in FIG. 1, taken along line 2—2;

FIG. 3A is a sectional view of the self-extinguishing cigarette according to the present invention showing a sleeve in an original position;

FIG. 3B shows a blow up view of the stopper of the cigarette body;

FIG. 4 is a side elevational view of the self-extinguishing cigarette according to the present invention showing the sleeve in full lines in a flame position of a last end of the cigarette body, in operative use; and FIG. 5 is a side elevational view of the self-extinguishing cigarette according to the present invention showing the sleeve in full lines in a squeezing and wrinkling configuration on the lit end of the cigarette body, which has been extinguished by using the sleeve of the present invention.

DESCRIPTION OF THE PREFERRED EMBODIMENTS

Referring now in detail to the drawings for the purpose of illustrating preferred embodiments of the present invention, the self-extinguishing cigarette 10 as shown in FIGS. 1, 2, and 3, comprises a cigarette body 13, an annular stopper 12 attached on a cigarette filter 14, and a sleeve 11 slidably and longitudinally moved along the cigarette body 13 from the annular stopper 12. The present invention is described here in terms of a cigarette, however, the inventive concept can be applied to cigars and the like.

The sleeve 11 is made of vinyl plastics, so that it will melt and will not maintain form stability at high temperatures. That is, when the sleeve 11 is brought in contact with a flame position of the lit end of the cigarette body 13, the sleeve 11 is wrinkled and collapses in approximately one or two seconds as shown in FIG. 5. Accordingly, the lit cigarette is immediately extinguished in approximately one or two seconds.

The vinyl plastic is any of a series of polymers (resins) derived by polymerization or copolymerization of vinyl monomers ($CH_2$=CH—) including vinyl chloride and acetate, vinylidene chloride, methyl acrylate and methacrylate, acrylonitrile, styrene, the vinyl ethers, and numerous others. Specifically, polyvinyl chloride acetate, alcohol, etc., and copolymers or closely related materials. See under both vinyl and polyvinyl (Condensed Chemical Dictionary, Gessnerg Hawley). The sleeve 11 is not toxic when heat is applied.

The sleeve 11 is thin-walled, in the order of the thickness of ordinary paper such as approximately 0.01 mm to 3.0 mm. The inner diameter is approximately equal to, but slightly greater than, an ordinary cigarette so that the cigarette is slid into and out of the sleeve 11 easily.

The annular stopper 12 is made of paper or vinyl plastics similar to the sleeve 11. At this time, the annular stopper 12 is attached on a cigarette paper 16 of the cigarette filter by using non-toxic adhesive 18. Another embodiment of the annular stopper 12 is an annular raised portion which can be extended from an annular end portion of the cigarette filter 14. The annular stopper 12 prevents the sleeve 11 from separating from the cigarette body 13.

The self-extinguishing cigarette 10 according to the present invention operates as follows. As shown in FIGS. 4 and 5, when the smoker wants to extinguish the lit cigarette, the smoker moves the sleeve 11 to the flame position at the lit end 15 of the cigarette body 13 (FIG. 4). At this time, the sleeve 11 is immediately wrinkled around the flame position at the lit end 15 and simultaneously extinguishes the lit cigarette completely in one or two seconds (FIG. 5). Accordingly, the squeezed and wrinkled sleeve 17 stores ash automatically as a kind of function of an ashtray, and does not create any unpleasant odors or sparks.

Generally, the self-extinguishing cigarette 10 of the present invention is approximately the same as the ordinary cigarette. Therefore, the self-extinguishing cigarette 10 can be packed in the ordinary cigarette package 19 (FIG. 1). Accordingly, the self-extinguishing cigarette 10 is simple in structure, inexpensive to manufacture, and refined in appearance.

The present invention can also be used without the stopper 12. However, the stopper 12 is helpful in insuring that the sleeve 11 does not slide off of the cigarette body 13. In the use of the present invention with a cigar, the sleeve 11 could constitute the wrapper which is commonly placed around the cigar. In this way, cigars, which are commonly expensive, can be extinguished and relit.

The invention being thus described, it will be obvious that the same may be varied in many ways. Such variations are not to be regarded as a departure from the spirit and scope of the invention, and all such modifications as would be obvious to one skilled in the art are intended to be included within the scope of the following claims.

What is claimed is:

1. A self-extinguishing cigarette which consists essentially of:

a cigarette body;

a cigarette filter connected to said cigarette body;

a plastic annular sleeve coaxially disposed on said cigarette body for slidably and longitudinally moving along said cigarette body, said plastic annular sleeve formed of a polymer selected from the group consisting of vinyl chloride, vinyl acetate, vinylidene chloride, methyl acrylate, methyl methacrylate, acrylonitrile, styrene, vinyl ethers, and polyvinyl chloride; and an annular stopper attached on one end of said cigarette filter for maintaining the annular sleeve on the cigarette body, whereby upon moving the sleeve to a lit end of the cigarette body, the sleeve wrinkles upon exposure to heat and effectively extinguishes the lit cigarette within approximately two seconds.

2. The self-extinguishing cigarette of claim 1, wherein said sleeve has a thickness of approximately 0.01 mm to 3 mm.

3. The self-extinguishing cigarette of claim 1, wherein said annular stopper is an annular raised portion disposed around said cigarette filter and extends from said cigarette filter.

4. A self-extinguishing smoking device which consists essentially of:

a tobacco filled body;

a wrapping disposed around said tobacco filled body; and an annular plastic sleeve coaxially disposed around said wrapping for slidably and longitudinally moving along said tobacco filled body, said annular plastic sleeve formed of a polymer selected from the group consisting of vinyl chloride, vinyl acetate, vinylidene chloride, methyl acrylate, methyl methacrylate, acrylonitrile, styrene, vinyl ethers, and polyvinyl chloride, whereby upon moving said sleeve to a lit end of the tobacco filled body, the sleeve wrinkles upon exposure to heat and extinguishes the lit smoking device within approximately two seconds.

5. The self-extinguishing smoking device of claim 4, wherein said sleeve has a thickness of approximately 0.01 mm to 3 mm.

6. A method of extinguishing a cigarette, comprising the steps of:

providing a slidable plastic annular sleeve formed of a polymer selected from the group consisting of vinyl chloride, vinyl acetate, vinylidene chloride, methyl acrylate, methyl methacrylate, acrylonitrile, styrene, vinyl ethers, and polyvinyl chloride on a cigarette body; and sliding said slidable plastic annular sleeve over a lit end of the cigarette, whereby said slidable plastic annular sleeve wrinkles upon exposure to heat and extinguishes the lit cigarette within approximately two seconds.

* * * * *